US006073879A

United States Patent [19]

Sokolovsky et al.

[11] Patent Number: 6,073,879

[45] Date of Patent: Jun. 13, 2000

[54] ROCKET WITH LATTICE CONTROL SURFACES AND A LATTICE CONTROL SURFACE FOR A ROCKET

[75] Inventors: Gennady Alexandrovich Sokolovsky; Vladimir Nikolaevich Belyaev; Vladimir Grigorievich Bogatsky; Evgeny Alexandrovich Bychkov, all of Moscow; Valentin Vladimirovich Vatolin, Moscovskoi obl.; Alexei Viktorovich Grachev, Moscow; Daniil Leonidovich Dreer, Moscow; Vladimir Petrovich Emelianov, Moscow; Alexei Mikhailovich Iliin, Moscow; Vladimir Vladimirovich Ischenko, Moscow; Mikhail Anatolievich Kryachkov, Moscow; Oleg Nikolaevich Levischev, Moscow; Lazar Iosifovich Lerner, Moscow; Nikolai Afanasievich Maloletnev, Moscow; Vladimir Ivanovich Pavlov, Moscow; Viktor Fedorovich Piryazev, Moskovskoi obl.; Vadim Andrianovich Pustovoitov, Moscow; Anatoly Lvovich Reidel, Moscow; Vadim Konstantinovich Fetisov, Moscow; Sergei Lvovich Shmuglyakov, Moscow, all of Russian Federation

[73] Assignee: Vympel State Machine Building Design Bureau, Russian Federation

[21] Appl. No.: 08/930,076

[22] PCT Filed: Apr. 29, 1996

[86] PCT No.: PCT/RU96/00102

§ 371 Date: Apr. 13, 1998

§ 102(e) Date: Apr. 13, 1998

[87] PCT Pub. No.: WO96/35613

PCT Pub. Date: Nov. 14, 1996

[30] Foreign Application Priority Data

| | | | |
|---|---|---|---|
| May 11, 1995 | [RU] | Russian Federation | 95107195 |
| May 11, 1995 | [RU] | Russian Federation | 95107196 |
| May 11, 1995 | [RU] | Russian Federation | 95107199 |

[51] Int. Cl.[7] ..... F42B 10/14

[52] U.S. Cl. ..... 244/3.28

[58] Field of Search ..... 244/3.28, 3.27, 244/3.24, 3.25, 3.29, 3.3, 113, 110 D; 102/439, 400; 114/23, 21.1, 21.2, 21.3

[56] References Cited

U.S. PATENT DOCUMENTS

| | | | |
|---|---|---|---|
| 2,846,165 | 8/1958 | Axelson . | |
| 3,047,259 | 7/1962 | Tatnall et al. | 244/113 |

(List continued on next page.)

FOREIGN PATENT DOCUMENTS

| | | |
|---|---|---|
| 2019833 | 10/1970 | France . |
| 2109502 | 5/1972 | France . |
| 2468503 | 8/1981 | France . |

OTHER PUBLICATIONS

S. M. Belotserkovsky, "Reshetchatye Krylya," 1985, "Mashinostroenie," pp. 10–12, Figs. B1–B3, B5.
Flight International, Mar. 4–10, 1992, N4308, pp. 24–25.
Flight International, Mar. 11–17, 1992, N4309, p. 15.
Kryl'va Rodyny, N8–93 (p. 26 and picture), Date Unknown.

*Primary Examiner*—Harold J. Tudor
*Attorney, Agent, or Firm*—Garrison & Associates PS; David L. Garrison

[57] ABSTRACT

The group of inventions pertains to rocket technology, in particular guided rockets, and can be used in various types and classes of rocket with lattice control surfaces, and in the rocket control surfaces. The rocket is of a standard aerodynamic design and comprises a body (1) with a motor assembly, a guidance and control system apparatus, fixed wings (2) and movable lattice control surfaces (3) of a control system, said control surfaces being spaced evenly on the outer body along the latter's longitudinal axis. In the reinforcement frame, side members (18, 19) are designed so as to narrow towards the end region of the control surface; the root surface (22) is broader than the end surface (23), the thickness of the lattice planes (24, 25) narrowing either continuously or in steps towards the end region.

15 Claims, 10 Drawing Sheets

U.S. PATENT DOCUMENTS

Figure 1:
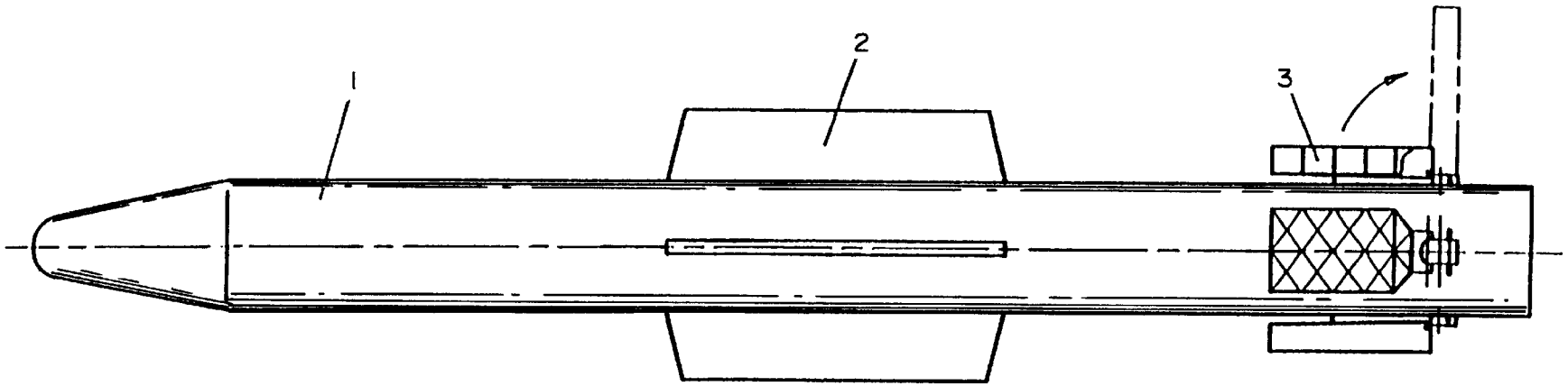

| | | | |
|---|---|---|---|
| 3,064,930 | 11/1962 | Chevalier . | |
| 3,944,168 | 3/1976 | Bizien et al. | 244/3.28 |
| 4,560,121 | 12/1985 | Terp | 244/3.28 |
| 4,641,802 | 2/1987 | Zalmon et al. | 244/3.28 |
| 4,660,786 | 4/1987 | Brieseck et al. | 244/3.29 |
| 4,884,766 | 12/1989 | Steinmetz et al. | 244/3.27 |
| 5,048,773 | 9/1991 | Washington et al. | 244/3.28 |
| 5,114,095 | 5/1992 | Schroppel et al. | 244/3.28 |
| 5,192,037 | 3/1993 | Moorefield | 244/3.28 |
| 5,549,065 | 8/1996 | Cipolla et al. | 114/23 |
| 5,551,364 | 9/1996 | Cipolla et al. | 114/23 |
| 5,584,448 | 12/1996 | Epstein et al. | 244/3.28 |
| 5,642,867 | 7/1997 | Klestadt | 244/3.27 |

18
19
20
21
22
23
24
25
26
A
B
C
D
E
G
H
J
K
2
$\delta_i$
$\delta_{i+1}$
$\delta_1$

ROCKET WITH LATTICE CONTROL SURFACES AND A LATTICE CONTROL SURFACE FOR A ROCKET

TECHNICAL FIELD

The invention relates to field of rocket or missile technology, in particular to guided rockets, and can be used for various types and classes of rockets with lattice control surfaces; the invention concerns also a lattice control surface and can be used in control systems.

PRIOR ART OF THE INVENTION

Rockets are known which are made according to standard aerodynamic design, containing a propulsion system located in the body and control and guidance apparatus, fixed wings and lattice control surfaces of the control system, located on the body in regular intervals around its centerline and having lifting surfaces formed by planes.

Such a rocket with a different degree of disclosure was described in the following journals: "FLIGHT INTERNATIONAL" on Mar. 4–10, 1992, N4308, page 24 . . . 25, "FLIGHT INTERNATIONAL" on Mar. 11–17, 1992, N4309, page 15 and the most completely in the journal "KRYL'YA RODYNY" (in Russian), N8-93 (Colour picture and page 26).

Realization of a rocket with lattice control surfaces allows use of small-sized and low energy consuming drives in control systems, which provides decreased mass and dimensional characteristics of the rocket as a whole.

At present lattice control surfaces of various shapes and different design are used in control systems of rockets of different kinds and purposes. One of the basic characteristics of a lattice control surface in distinction from a monoplane is the following. In a monoplane design the load-carrying components are located under the skin and do not participate in the creation of aerodynamic forces. In a lattice control surface the load-carrying components are in exposed to the air or fluid flow and, hence, form the lifting area of the control surface, i.e. the elements of a lattice control surface perform a double role—both load-carrying design and aerodynamic surface. A consequence of this is the fact that the lifting force (lift) of a lattice control surface is several times higher than the lift of a monoplane control surface of equal volume.

The ability to decrease lattice control surface volume, in comparison with the volume of a monoplane control surface, results in essential reduction of a drag force (drag) from the oncoming flow, since the lattice control surface actually represents a thin-walled truss, having, in addition to other positive features, advantages in comparison with a monoplane design in rigidity and weight parameters.

The lattice control surface of the rocket with arrangement of the lattice planes at angle of 45° to the frame is known (so-called cellular design), (see B. M. Belotserkovsky, L. A. Odnovol etc., Reschetchatye Kryl'ya; Moscow, "Mashinostroeniye", 1985 (in Russian), page 300, FIG. 12.2, B).

The noted lattice control surface contains a load-carrying frame of the rectangular shape, including side bars, root and tip planes and units of attachment of the control surface to the control drive shaft, and the set of the planes with various thickness located inside the frame, forming a lattice as honeycomb. Various thickness of the planes is provided by strengthening of some planes within the limits of the surface scope. Jointing of the planes in a lattice is made by a standard technology by means of counter slots with subsequent soldering. The blanks of the planes are made with wedge-shaped sharpening at front and rear edges (see the same source, pages 216 . . . 223).

The advantages of the above specified control surface are determined by general advantages of lattice control surfaces in comparison with conventional monoplane control surfaces. At the same time, the design of the known lattice control surface has a number of disadvantages, including:

- In the design of the lattice panel (that is formed by the load-carrying frame and the lattice itself) the inclusion of thickened planes along the span of a control surface results in relative increase of a drag force for the given control surface;
- On the lattice of the control surface in places where the planes are sharpened at the leading edge and not soldered, areas of slots are exposed. In some modes of flight this can result in the appearance of a shock wave in the non-soldered areas, which increases drag on the control surface, lowers its total lift, and causes local overheating of the planes, i.e. will decrease their strength and as a result will affect the parameters of the rocket flight;
- Location of the attachment units of the control surfaces to the rocket at corners of the load-carrying frame results, when the lattice control surface is used as the controlled one, in an increase of overall dimensions of the output element for drive protruding in a flow, i.e. in an increase in its drag, and weakens the body of the rocket in this area, reducing the possibility of recessing the output link in the body;
- The necessity of making slots in blanks of the thin lattice planes results in complication of the control surface manufacturing technology: the necessity of piling blanks, milling or punching slots in a die, trimming burrs in slots and at sharp edges, fixing of the planes at soldering etc.; and
- Introduction into the design of the lattice of the strengthened or thickened planes along the span of the control surface necessitates the making of slots of various width in blanks of the planes of the lattice and in various areas of the planes, which significantly complicates and increases cost of the technological process of the planes manufacturing.

Analysis of the above-stated drawbacks shows that they essentially reduce operational and design characteristics of the known lattice control surfaces and manufacturability of their production, and in some extent limit the possibilities of its use.

DISCLOSURE OF THE INVENTION

The purpose of the invention is improvement of rockets or missiles having lattice control surfaces and of the lattice control surfaces themselves. Until the invention disclosed herein there was a need to develop a rocket capable of flight at all angles of attack and possessing superior manoeuvrability and aerodynamic characteristics. Design features of the rocket and its lattice control surfaces thus should not decrease significantly any lift or normal force coefficient or increase any drag coefficient. During development of the rocket and the lattice control surface design it was necessary to create a design having a combination of the following properties: reduced drag, improved manufacturability (in comparison with known designs), and improved weight response, in order to allow improvement of geometrical characteristics of the rocket, its power, dynamics etc. A further object of the invention was to provide deployment of the lattice control surfaces and their fixing or restraint in the unfolded position at launch of the rocket by creating special mechanisms, that provides high flying-tactical characteristics, and also minimum overall dimensions during transportation and storage of rockets. In addition to provision of folding—deployment of control surfaces, usage of the invention allows increased reliability of control surface fixation in folded and unfolded positions.

These specified technical results are reached by providing a rocket comprising standard aerodynamic design, a propulsion system located in its body, instrumentation for the control and guidance systems, and also the fixed wings and the movable lattice control surfaces of a control system, located on the body in regular intervals relative to its centerline and having lifting surfaces formed by planes, where the wings, the lattice control surfaces, and the body are made with the following ratios of dimensions:

$$\bar{S}_w = 2S_w / S_M = 3-11; \quad \bar{S}_p = 2S_p / S_M = 1.5-3; \quad H_p / L_p = 0.3-0.55;$$

$$\bar{t}_p = t / b = 0.6-1; \quad n = H_p / t + 1 = 3-5;$$

$$S_p = nL_p b; \quad \lambda_w = L^2 / 2S_w = 0.2-0.5;$$

$$\lambda_k = L_k / D_{eq} = 16-20; \quad D_{eq} = \sqrt{4S_M / \pi}$$

Where:

$S_w$ - Area of wing;

$\bar{S}_w$ - Specific area of wing;

$\bar{S}_p$ - Specific area of lattice control surface;

$S_M$ - Mid-section area of rocket;

$H_p$ - Height of lattice control surface;

$S_p$ - Area of lifting surface of lattice control surface;

$L_p$ - Span of lattice control surface;

$\lambda_w$ - Wing elongation;

$L$ - Span of wing;

$\lambda_k$ - Rocket body elongation;

$L_k$ - Rocket length;

$t$ - Pitch of planes of lattice control surface;

$D_{eq}$ - Diameter of circle, area of which equals mid-section area of rocket;

$b$ - Width of lattice control surface plane;

$\bar{t}_p$ - Specific pitch of lattice control surface planes;

$n$ - Number of planes of lattice control surface.

The rocket has a mechanism for deployment of the control surfaces and their restraint or fixation in unfolded and folded positions, and also a pyrotechnic pressure accumulator for the deployment mechanism, thus the lattice control surfaces are provided with pins having grooves for fixation of the control surfaces in a folded position. In the body of the rocket apertures for the pins of the control surfaces are made, and in the root part of the control surfaces assembly apertures are made. Thus each control surface deployment mechanism comprises a pneumatic cylinder located in the body of the rocket, a chamber disposed beneath a piston which communicates with the pyrotechnic pressure accumulator, a spring-loaded piston for fixation of the control surface in its undeployed or unfolded state, and a rod, fixed in the front part of the end of the shaft of the control surface drive and located by its ends in the correspondent assembly apertures of the root part of the control surface. Each mechanism of the control surface fixation in the unfolded position comprises a spring loaded rod, located in a rear part of the end of the shaft of the control surface drive and adapted to engage a corresponding assembly aperture in the root part of the control surface. Moreover each mechanism for holding the control surface fixed in the folded position comprises clamping scissors, located in the mechanism and adapted to engage the pins of the control surfaces in their folded position and the rods of the pneumatic cylinders pistons in the unfolded position. The rods are made of sufficient length to ensure their ability to block the apertures of the rocket body at the unfolded position of control surfaces.

Preferred embodiments of the rocket provide for synchronized functioning of the above-described mechanisms and for protection from dust and water at unfolded and folded positions of the control surfaces. For provision of an optimum force and travel of the deployment mechanism and elimination of torque, the relatively rigid fixing of the end of the drive shaft the pin of each control surface is mounted on one of the lattice control surface planes intersections at or near its centre of mass.

To avoid damage to the rocket body coating and to the planes of the lattice control surfaces in the folded position, the pin of each control surface is of a length sufficient to ensure the presence of a gap between the rocket body and the appropriate control surface. Protection from dust and water of the rocket body is provided because the rods of each pneumatic cylinder piston has a groove for its fixation by the clamping scissors at the unfolded position of the control surfaces.

The lattice control surface of the rocket comprises a load-carrying frame of rectangular shape, including side bars, root and tip planes and units for attachment of the control surface to the drive shaft, and a set of planes of various thickness located inside the frame, forming a lattice like a honeycomb.

In order to provide a lattice control surface design having, along with reduced drag, an increased manufacturability and superior weight response, as claimed in the invention, a number of interconnected design solutions are implemented.

Side bars of the frame are made with smooth, tapered reduction of thickness, the root and tip planes are made with different thicknesses, decreasing along the span of the control surface from its root to tip, the planes of the lattice are made with smooth or discrete reduction of thickness, decreasing at length of the plane from root to tip along the span of the control surface.

Taking into account that the tip components of the control surface practically are loaded in flight less than the root ones, such a design solution allows by means of the narrowing of the planes and sidebars a reduction in drag on the control surface as a whole. At the same time, weight of the specified design elements and weight of the control surface is also reduced on the whole, which increases weight response of the design, reduces moments of inertia of the control surface relative to its longitudinal and lateral axes and, as a result, increases the dynamic parameters of the drive and the rocket as a whole.

The planes of the lattice are formed by jointing of a certain number of W-shaped plates of various thickness from row to row, smoothly or discretely tapering or narrowing at span of the control surface to its tip portion and supported at the ends upon internal surfaces of the lateral frame bars, and the envisioned direct lines, drawn through the initial apexes of the projections of each row of W-shaped plates are parallel the root plane of the frame. With such construction the design-technological task of shaping of the tapered or narrowing plane thickness along the span from a root to a tip portion of the control surface is solved. Walls of the W-shaped plate, installed on the root surface plane, are continued by the plate of the following row installed on it and so on, the thickness of the walls of the following rows decreasing either smoothly or discretely. Therefore the complex planes of the lattice are formed having decreasing thickness along its length from the root to the tip portion of the plane, the thickness decreasing either smoothly or discretely. As a consequence of the decrease in control surface approaching the tip portion along the span of the planes, drag on the control surface is reduced.

The lattice control surface of the invention has base areas in the interfaced apexes of the W-shaped plates in places of contact among themselves. This enables installation of the W-shaped plates "row upon another row" through the previously made base areas, by welding a row to a row by dot or condenser welding, by forming technological "cellular block" or honeycomb. Thus the walls of the W-shaped plates of one row can be adjusted in the unified inclined plane with the walls of the upper rows, and possible displacement of components of each plane is reduced to the minimum, resulting in a reduction of drag on the control surface.

In the claimed lattice control surface the W-shaped plates are jointed among themselves and to the frame forming single-piece design by welding or soldering. To further ease joining of the W-shaped plates, use of technological "cellular block" or honeycomb can be complemented by the root and tip planes. To this end the "cellular block" or honeycomb may be mechanically processed for increased accuracy or better fit at interfaced dimensions with side bars of the frame. Then single-piece jointing of load-carrying elements of the control surface among themselves is accomplished by welding (for example by laser) or by soldering into a unified load-carrying unit. Into the specified load-carrying unit a load-carrying bracket is included. Such an arrangement of the technological process of the surface assembly results in reduction of technological waste to a bare minimum, influencing such parameters as increased drag of the lattice control surface owing to deviations of the geometrical dimensions of the control surface elements from their computed values or reduction of constructional rigidity of the panel owing to insufficient soldering in jointing of surface elements that can take place, for example, in prior-art type control surfaces at soldering of the planes jointed "slot to slot", strength of assembly, etc. In a control surface according to the invention, the frames and side bars are made with wedge-shaped sharpening of front and rear edges.

As is known from theory, drag of a lattice control surface consists of friction drag and wave-making drag, and the value of wave-making drag is in direct proportion to the shape of a detail structure located in fluid flow. Thus sharpening of a detail (detail's) structure reduces wave-making drag. This is accomplished by the designs described herein.

In the claimed control surface sharpening of edges of the lattice planes is made symmetrical. As follows from the foregoing, sharpening of a detail structure, including the symmetrical sharpening, reduces wave-making drag of a detail. In this case this detail is plane. But the advantages of the planes sharpening are not limited to the foregoing. Neighboring planes, separated from each other at determinate distances (pitch of the lattice "t"), influence each other through formation of shock waves, coming from the front edge of one plane and falling on the trailing edge of its neighbor. This effect increases with angle of attack for the plane $\alpha$. The mutual effect is determined for the planes of symmetrical profile by thickness of the plane and wedge-shaped sharpening of front and rear edges with angle $2\theta$. It may be concluded from the foregoing that for reduction of drag on the control surface planes depending on implementation conditions it is necessary to make bilateral symmetrical sharpening of the planes. During construction of the control surface lattice with usage of the pre-formed W-shaped plates through the previously formed base areas it is possible to finish the contact area of the next rows of plates by cutting machining, forming in these areas symmetrical sharpening of the planes, thus reducing the formation of shock waves in areas of the "cellular block" wall joints, in distinction from the soldered jointing of the planes known as "slot to slot".

In preferred embodiments of the control surface the units of the control surface attachment to the shaft of the control drive are located in the central part of the root frame plane and are formed by bent or angled members of the frame side bars, jointed among themselves and with the root frame plane by the load-carrying bracket. Arrangement of attachment units of the control surface to the control drive shaft in the central part of the root plane between bent or angled members of frame side bars allows reduction of overall dimensions of the control surface in the zone of fastening and as a consequence permits attachment units of the control surface of the control drive shaft to be recessed into the body of the rocket, significantly reducing drag of the root part of the control surface. Bent or angled portions of the frame side bars in the zone of the attachment units make the design more rigid, reducing deformation from loads, which is important for operation of the control drive. Introduction of a load-carrying bracket into this zone, integrating by a force way the frame side bars and the root plane of the control surface into one unit, increases rigidity of the output drive units, that finally increases dynamic properties of the rocket. In the claimed control surface the load-carrying bracket is made of $\pi$-shaped and angle roof-shaped sections, and the legs of the $\pi$-shaped section are connected to the bent members of the frame side bars forming attachment eyes, and the apex of the angle roof-shaped section is connected to the root plane of the frame. In the attachment eyes through apertures are made for the surface attachment to the shaft of the control drive. Except functioning as load-carrying rigid binder of the frame elements (side bars and root plain), load-carrying bracket allows to pass from rather thin design load-carrying elements of the surface to stronger eyes with apertures for attachment of the surface to the control drive shaft. The bracket itself, being made of two details, represents the rigid spatial form that was produced and processed beforehand, and that increases manufacturability of assembling process.

In use the rocket according to the invention defeats air targets including highly manoeuvrable fighters and attack airplanes in the daytime and at night under simple and difficult meteorological conditions from any direction (omnidirectional) in the face of active informative (jamming) and manoeuvrable counteraction of the enemy. The rocket is capable striking such specific targets as a cruise missile, air-to-air rocket, etc.

Rockets with dimension ratios as claimed herein are well adapted for placement on carrier airplane having strict limitations on space, and simultaneously reduce by several times the required hinge moments required to drive the control surface (by a factor of approximately 7). This permits use of drives of smaller power and therefore of smaller weight, while retaining each of the advantages associated with lattice control surfaces. The optimum range of parameters is found by results of numerous researches of rockets of various geometry in wind tunnels and is confirmed by results of flight tests. The rocket with the specified ratio of the geometrical dimensions has high aerodynamic characteristics in all ranges of its application. Maximum angle of attack is $\alpha_{max} \approx 40–45°$, maximum permissible transverse g-load equals appr. 50 units on passive and on active legs of trajectory due to introduced limitation for hardware.

Outside the limits of the specified dimension ratios the rocket largely loses its manoeuvering capabilities due to significant increase of a drag coefficient $C_x$ and significant decrease of a normal force coefficient $C_y$.

Thus the dimensions ratio of the rocket being chosen in the specified limits provides its high manoeuvrable characteristics in range of attack angles $\alpha_{max} \approx 40–45°$ and values of factor $M \approx 0{,}6–5{,}0$.

Figure 2:
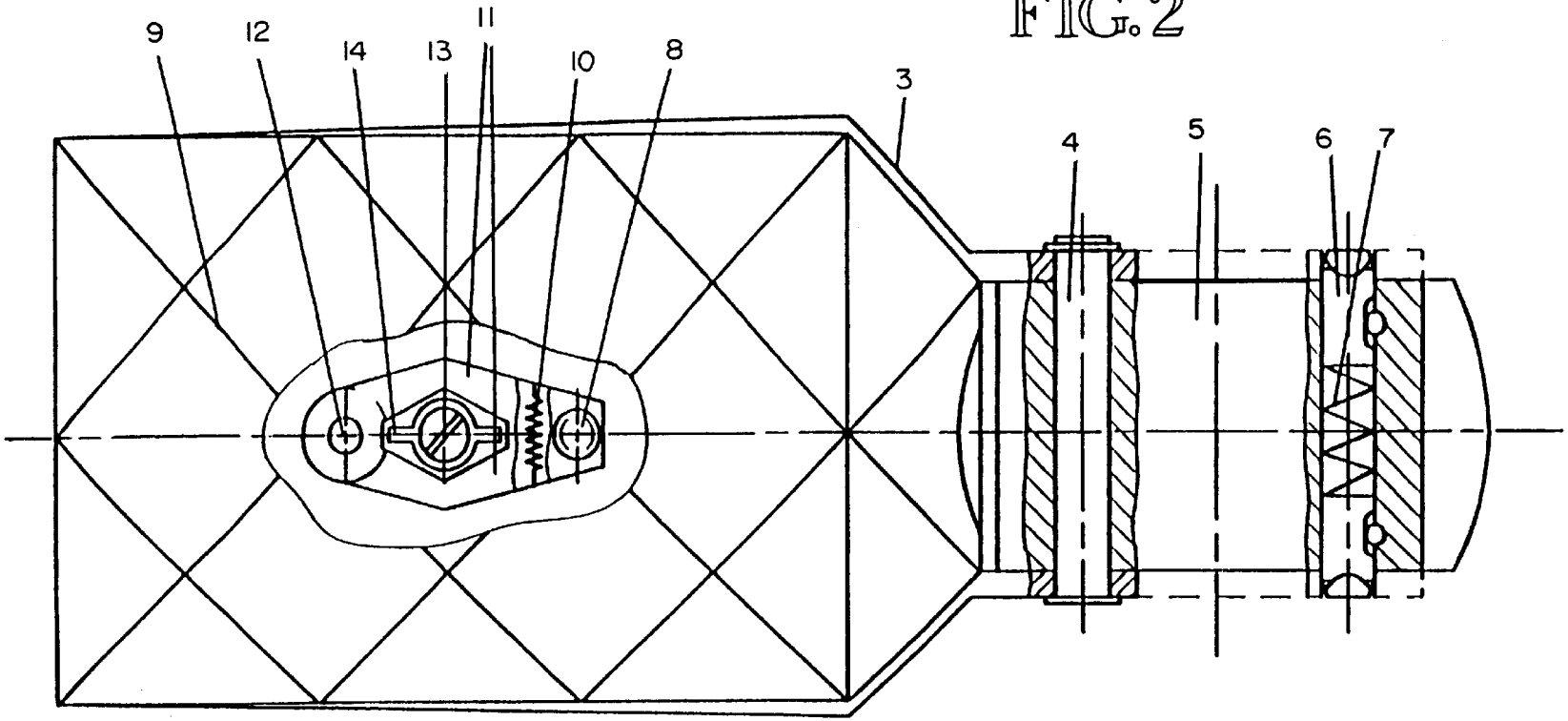
Figure 4:
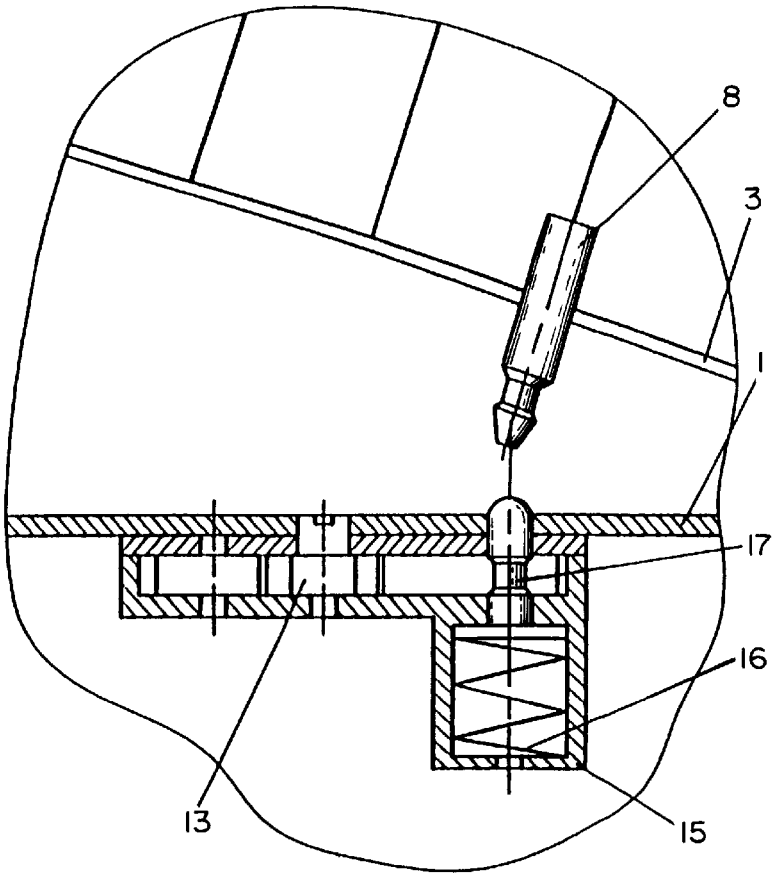
Figure 3:
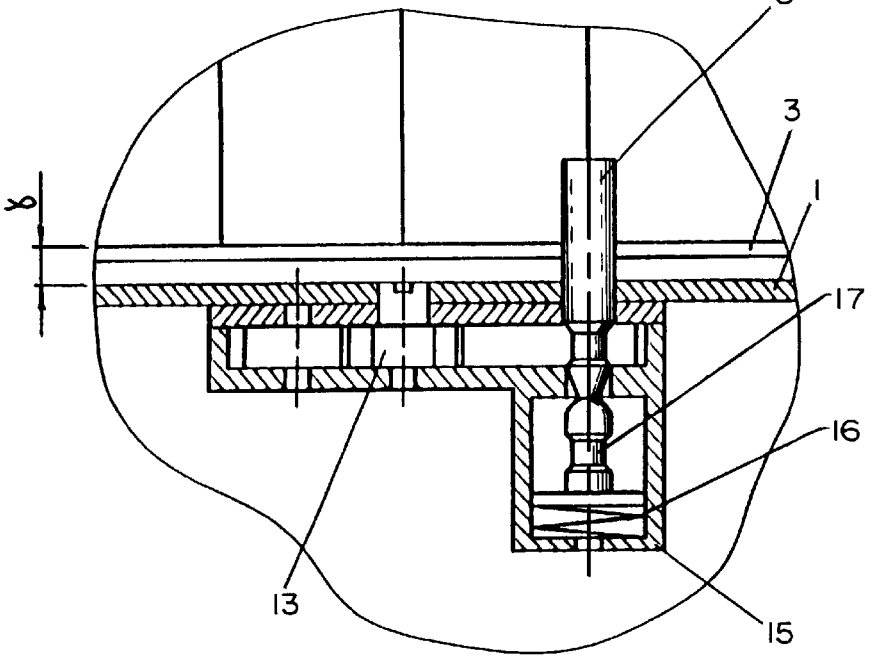
Figures 5, 6, 7, 8, 9:
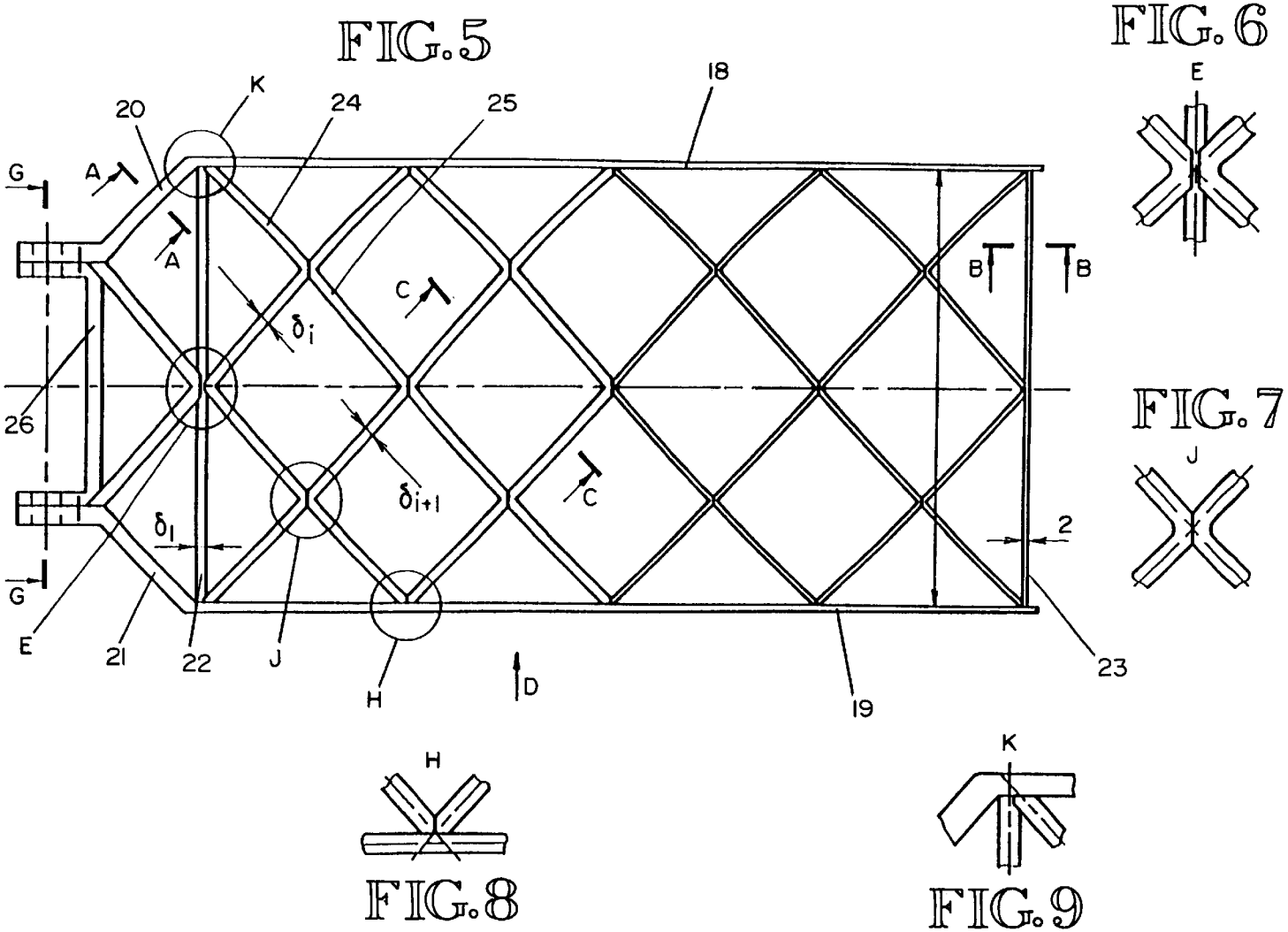
Figure 13:
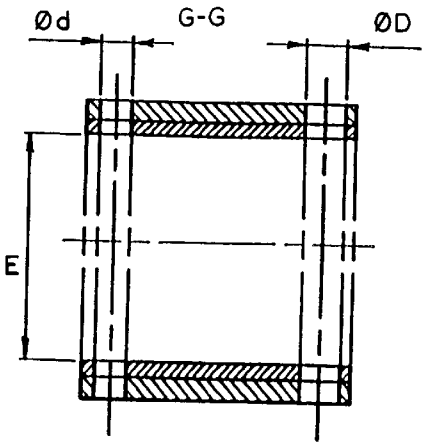
Figure 12:
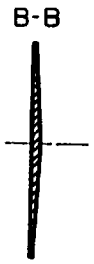
Figure 11:
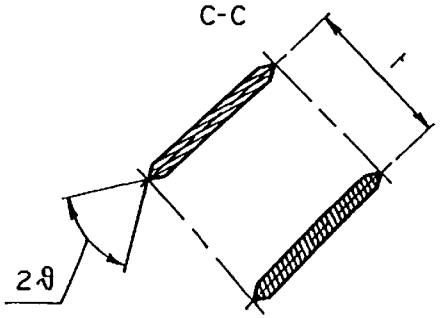
Figure 10:
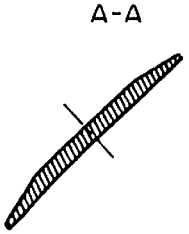
Figure 15:
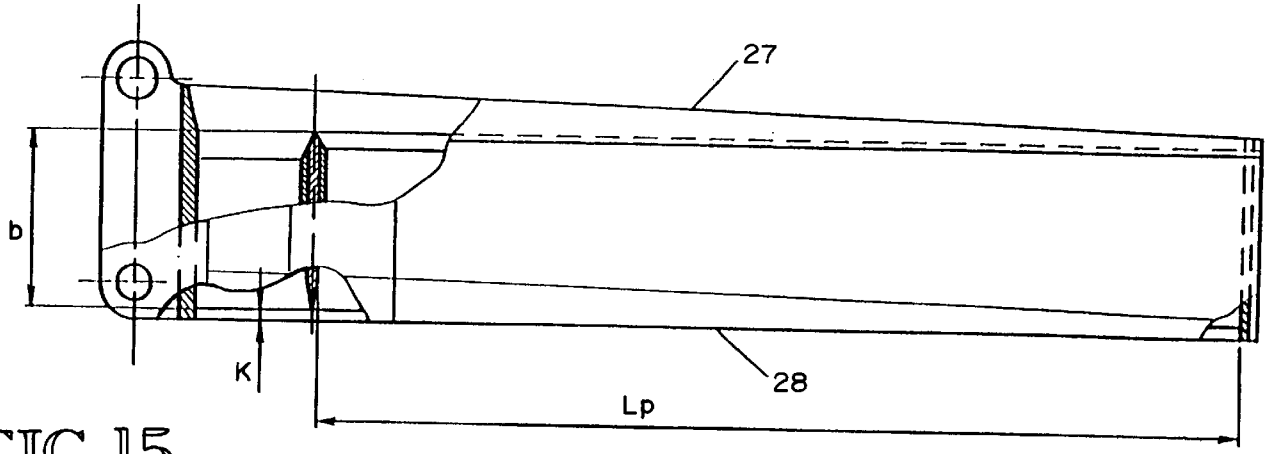
Figure 14:
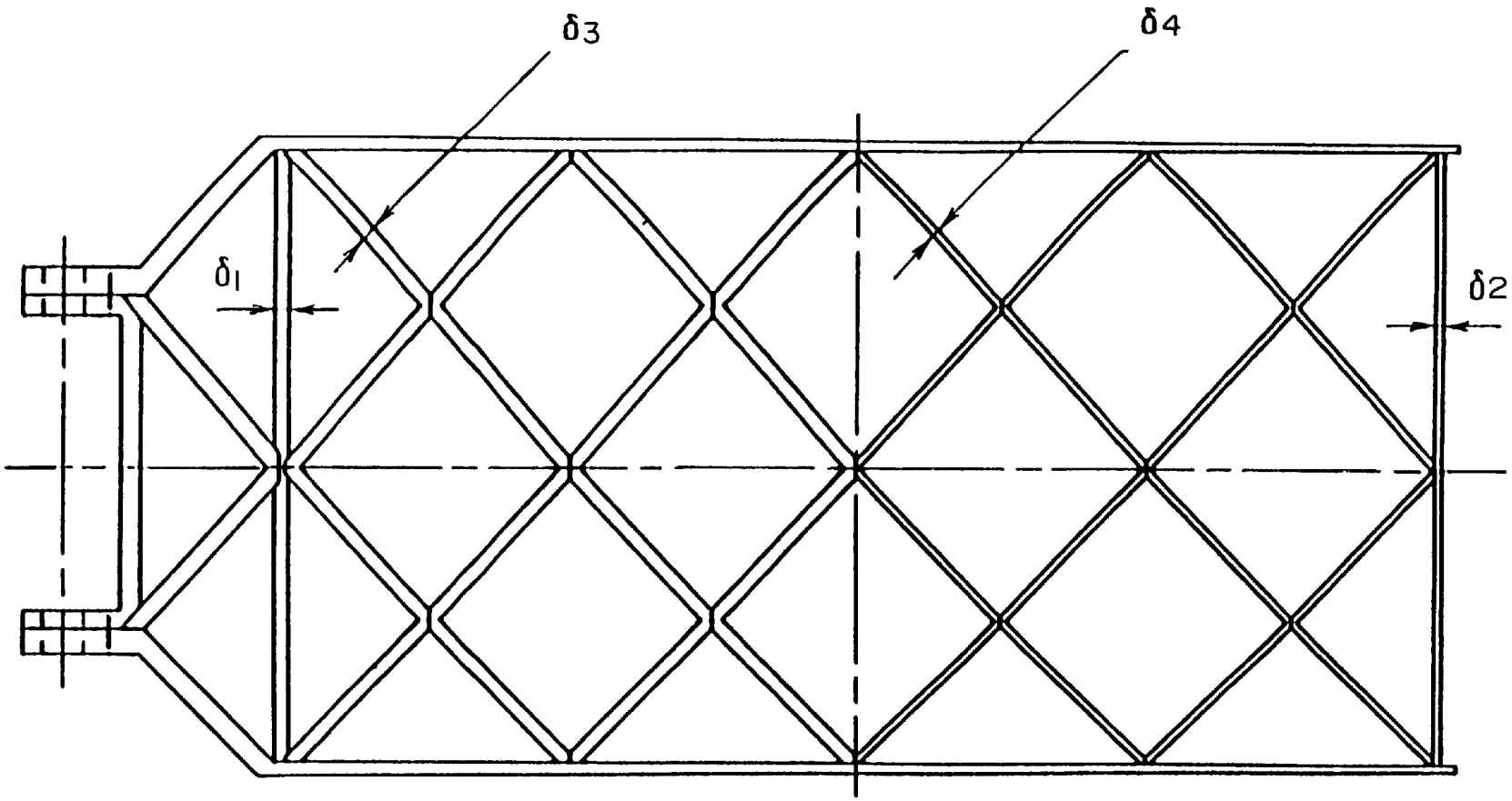
Figures 16, 17, 18:
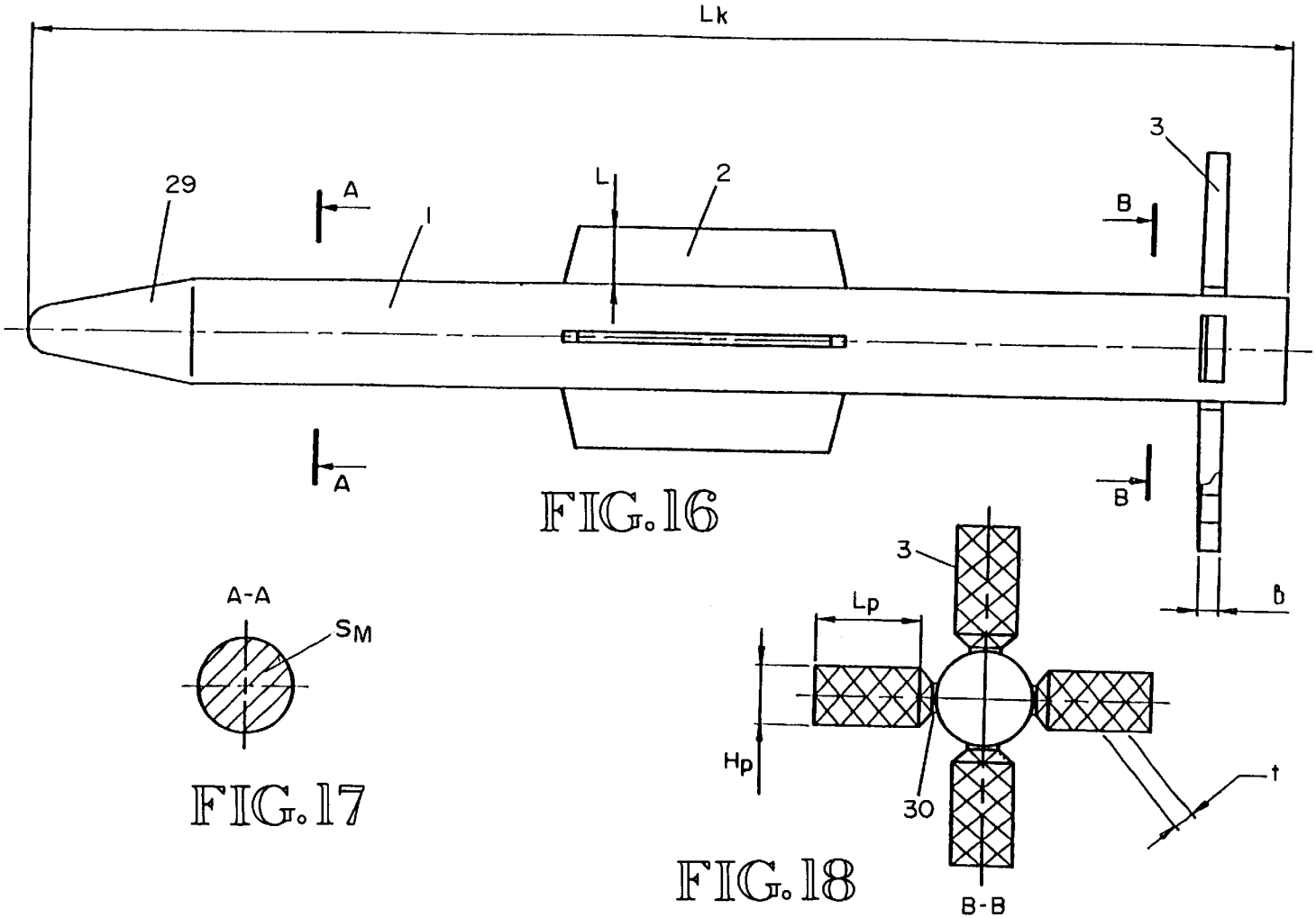
Figure 21:
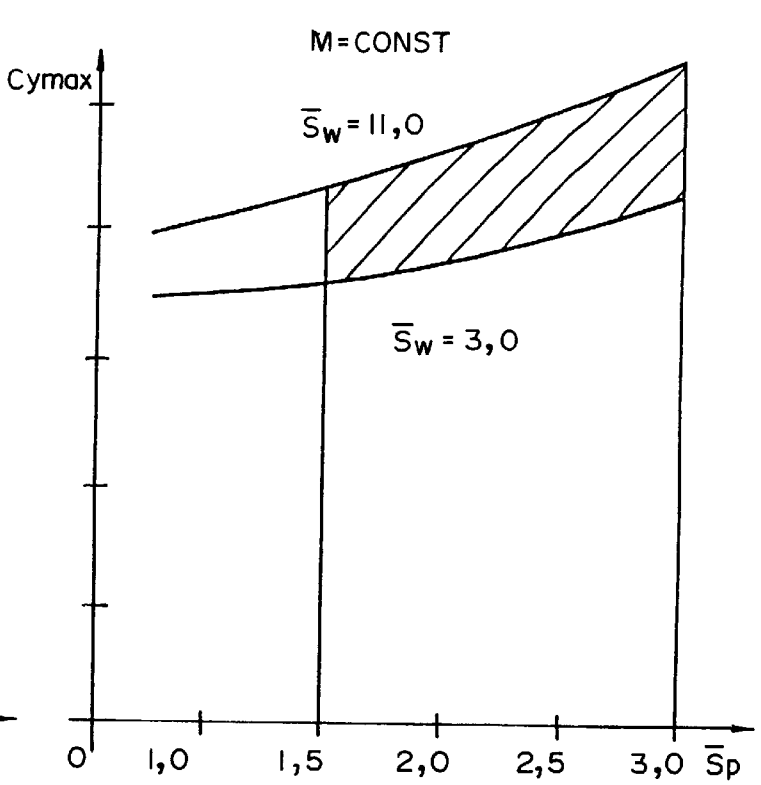
Figure 19:
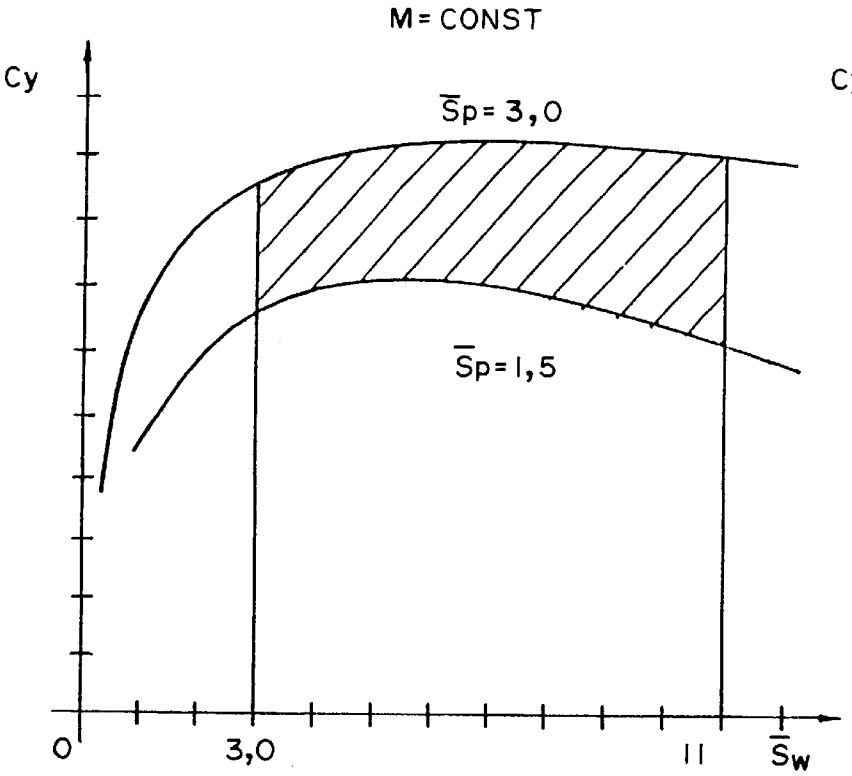
Figure 20:
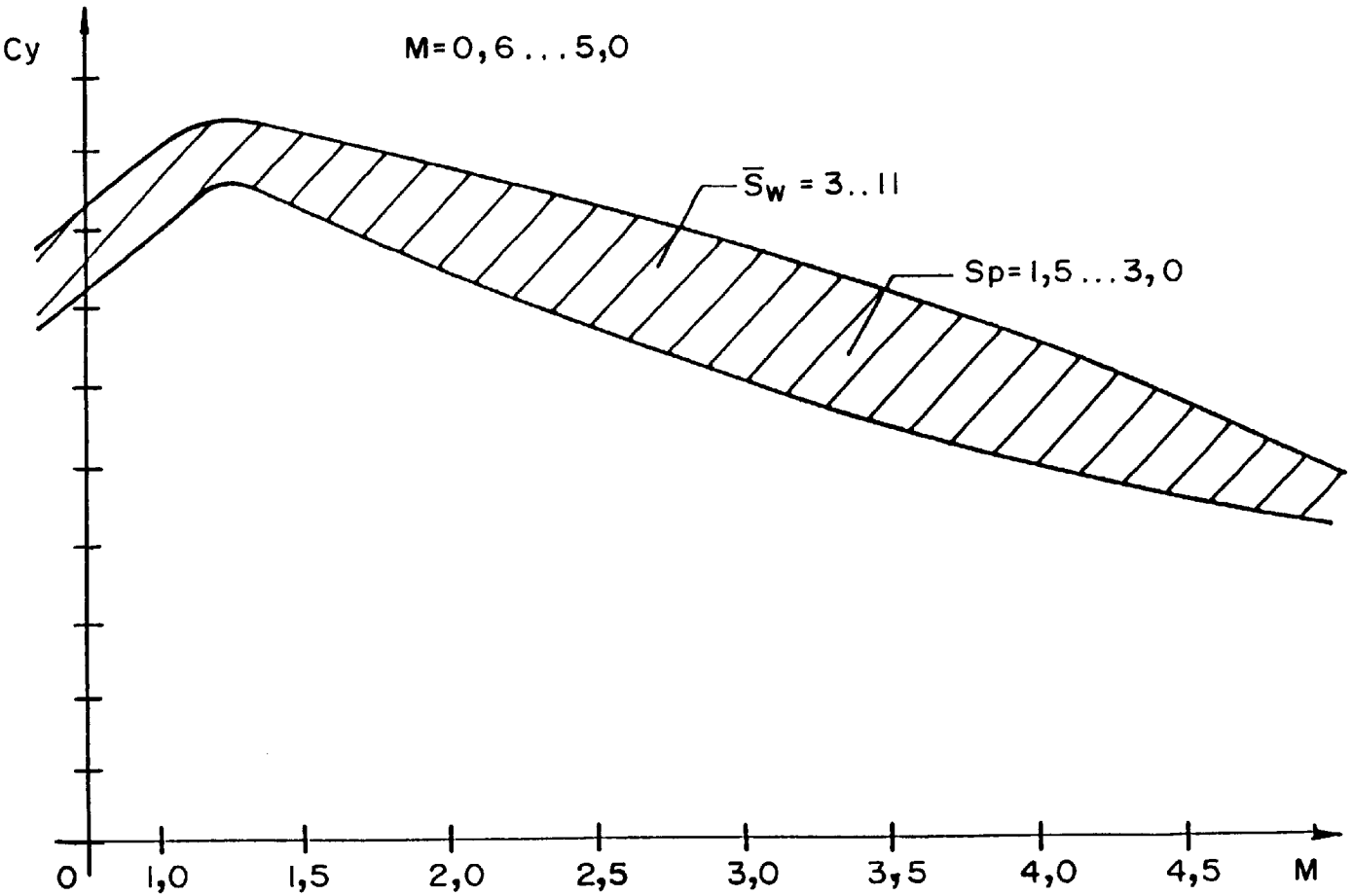
Figure 22:
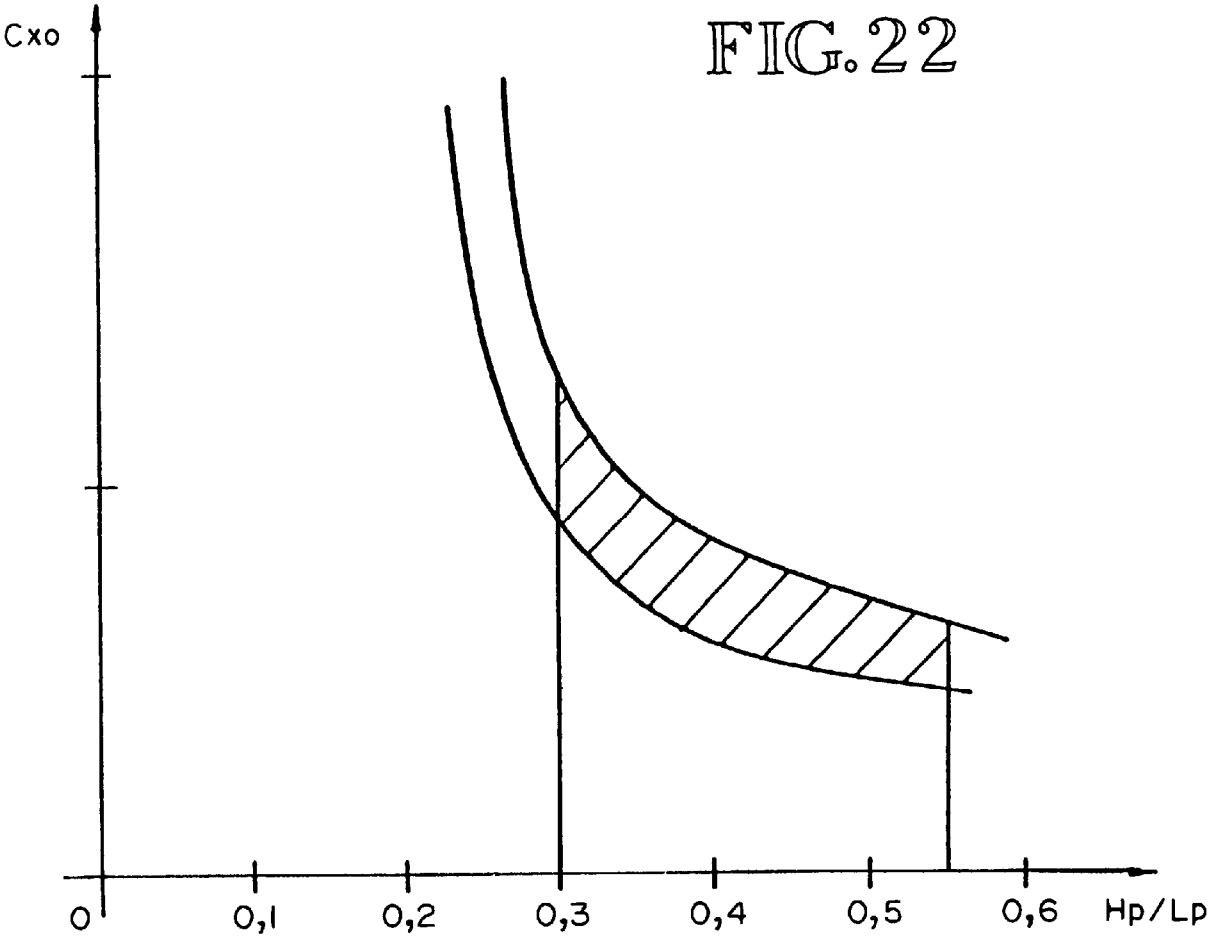

The essence of the invention is explained by graphic materials, where:

In FIG. 1—general view of rocket;

In FIG. 2—lattice control surface;

In FIG. 3—deployment mechanism in folded position of control surfaces;

In FIG. 4—deployment mechanism in unfolded position of control surfaces;

In FIG. 5—general design of lattice control surface with narrowing or tapering of lattice planes thickness;

In FIG. 6—view E of lattice control surface element, represented in FIG. 5;

In FIG. 7—view J of lattice control surface element, represented in FIG. 5;

In FIG. 8—view H of lattice control surface element, represented in FIG. 5;

In FIG. 9—view K of lattice control surface element, represented in FIG. 5;

In FIG. 10—cross-section A—A of FIG. 5;

In FIG. 11—cross-section C—C of FIG. 5;

In FIG. 12—cross-section B—B of FIG. 5;

In FIG. 13—cross-section G—G of FIG. 5;

In FIG. 14—general design of lattice control surface with discreet reduction of lattice planes thickness;

In FIG. 15—view D at side surface of lattice control surface of FIG. 5;

In FIG. 16—general view of a preferred embodiment of a rocket with unfolded control surfaces;

In FIG. 17—cross-section A—A of FIG. 16;

In FIG. 18—cross-section B—B of FIG. 16;

In FIG. 19—graphic representation of normal force factor relationship of specific wing area;

In FIG. 20—graphic representation of normal force factor relationship of factor M;

In FIG. 21—graphic representation of normal force ($C_{y\,max}$) relationship of specific area of lattice control surface; and In FIG. 22—graphic representation the dependence of drag coefficient of isolated lattice control surface ($C_{x\,o}$) relationship of relation of height of lattice control surface to its span.

VARIANTS OF THE INVENTION IMPLEMENTATION

The rocket with a standard aerodynamic design (FIG. 1) contains a body 1 and a propulsion system, a guidance and control system instrumentation (not shown on the drawings) located in it, four fixed wings 2 and four lattice control surfaces 3 of the control system, located on the body 1 in regular spacing around its centerline and shown in a folded position.

The rocket has mechanisms for deployment of the control surfaces and their fixation in unfolded and folded positions. Each lattice control surface 3 is connected to the drive by means of a rod 4 (FIG. 2), fixed in the front portion of the end 5 of the drive control surface shaft (not shown in drawings). The ends of rod 4 are located in assembly apertures of a root part of the control surface 3. Rod 4 serves as a rotational axis of the control surface 3 at its deployment.

The mechanism of the control surface fixation or restraint in an unfolded position comprises rods 6, located in a back part of the end 5 of the shaft of the control surface drive, pressed by the spring 7. On the ends of rods 6 bevels are made for their penetration into corresponding assembly apertures of the root part of the control surface 3 after rotation to the final "unfolded" position. Lattice control surfaces 3 are provided with pins 8 (FIGS. 2, 3, 4), fixed on the crossed planes 9 of the lattice control surfaces at or near the control surfaces' centres of mass, used for fixation of control surfaces 3 in a folded position and their moving to an unfolded position.

Each mechanism of the control surface fixation or restraint in a folded position comprises clamping scissors-type elements, consisting of fixing elements 11 pressed by spring 10, located on the axle 12. The clamping scissors are located in the body of the rocket so that to ensure catching and fixing of the pins 8 of the control surfaces 3 in a folded position.

Axle 13 having step-cams 14 is located between fixing elements 11. The head of axle 13 comprises a slot for a tool and is located for access from outside the rocket body (FIG. 3, 4). The head of the axle 13 is located between the planes 9 of the lattice control surfaces 3 for easy access with a tool.

Each mechanism of the control surface deployment comprises a pneumatic cylinder 15, located in the rocket body 1, and a pin 8 (FIG. 3, 4). A chamber under the piston of the pneumatic cylinder 15 is communicates with the pyrotechnic pressure accumulator (not shown on the drawings). The spring 16 serves to fix or restrain the piston of the pneumatic cylinder 15 in the initial or terminal position at deployment of the control surface 3. A rod 17 of the piston of the pneumatic cylinder 15 serves for pushing pin 8 out during deployment of the control surface 3. The pyrotechnic pressure accumulator may be an explosive device controlled by any suitable known method.

The length of the rod 17 of the pneumatic cylinder piston provides capability for blockage of the apertures in the rocket body 1 after escape of pins 8 out of them. Grooves at pins 8 and rods 17 ensure reliable fixation by means of clamping scissors. The length of pins 8 serves also to provide the necessary gap $\gamma$ (FIG. 3) between the rocket body 1 and planes of the lattice control surfaces 3 to prevent damage of them. Deployment of the rocket lattice control surfaces 3 is done in an automatic mode at the beginning of autonomous mission, and at periodical technical service also. At launch of the rocket the lattice control surfaces 3 are in a folded position. The propulsion system and guidance and control systems function conventionally for rockets of this type. The deployment of lattice control surfaces is made after operation of the pyrotechnic pressure accumulator with a signal of the control system of the rocket.

Under overpressure of gas or air, going into the chamber of the pneumatic cylinder 15, rod 17 overcomes the restraining effort of the clamping scissors, pushes out pins 8 of the control surfaces 3. In the pneumatic cylinder 15 spring 16 and clamping scissors 11 hold the rod 17 of the piston of the pneumatic cylinder 15 in the end position, at which the tip portion of the rod 17 blocks the aperture in the rocket body 1 after escape the pin 8 out of it, providing necessary protection from dust and water.

At deployment the lattice control surface 3 turns round the axis, formed by rod 4, to the point at which the ends of rods 6 under pressure of the spring 7 engage the assembly apertures of the root part of the control surface 3, thus ensuring the restraint of the control surface in an unfolded position.

For manual deployment of the lattice control surface 3 it is necessary to turn the head of the axis 13 with a tool until fixing elements 11 are separated by steps 14. Thus the rod 17 of the piston of the pneumatic cylinder 15 under force from the spring 16 will give initial effort to the pin 8 for turning the lattice control surface 3. Its subsequent movement (turn) is done manually until its fixation in an unfolded position by the method described above.

To move the lattice control surfaces 3 into a folded position it is necessary to push rods 6 into the apertures of the clamper, overcoming resistance of spring 7, to turn the control surface 3 until adjustment of the pin 8 with the appropriate aperture in the rocket body 1 and with the necessary force, overcoming resistance of the spring 16, to press on the rod 17 of the piston of the pneumatic cylinder, and to push it down under the surface. Thus the fixing elements 11 of the clamping scissors will be separated, releasing the rod 17 of the piston, and will capture the groove in pin 8, fixing it. In this position the lattice control surface 3 is kept for transportation, storage and joint flight of the rocket with the carrier.

Functionally the lattice control surface of the rocket represents a carrier system, consisting of a large number of planes of a restricted span having relatively small chord length, and actually being a thin-walled truss, i.e. represents a rather light and rigid design.

The basis of the design is a load-carrying frame, consisting of two symmetrical (mirror-reflected) side bars 18 and 19 (see FIG. 5), with figured bent members 20 and 21 in their root portion, made of a steel sheet, root 22 and tip 23 planes, made also of a steel sheet, jointed as a one-piece part. The side bars, root and tip planes are made with sharpened edges (see FIG. 10, 12), and the thickness of the lateral part decreases toward the end of the control surface.

Inside the frame a square-diagonal set of thin-walled pre-formed W-shaped plates is located, being installed "row on row". The first row of the set is put on the root plane 22, and the last row contacts the tip plane 23 by a single-piece joint. The W-shaped plates are in contact with side bars 18 and 19, being connected with them as a one-piece part. The W-shaped plates have base areas in places of contact among themselves, through which they are connected as one-piece parts. The specified W-shaped plates are installed on the root plane and against each other in such a manner that the envisioned direct lines, drawn through initial apexes of the projections of each row of W-shaped plates are parallel to the root plane of the frame. Since in blanks of a wall the W-shaped plates will form a 90° angle, two planes, for example 24 and 25 (see FIG. 5) will form a square honeycomb cell with a pitch "t". Thickness of planes in the given example are tapered smoothly with some step from the value $\delta_i$ to the value $\delta_i$+1 (for the planes 24 and 25) etc. up to the last row. The root and tip planes 22 and 23 have fixed thickness $\delta_1$ and $\delta_2$. The W-shaped plates are made with symmetrical wedge-shaped sharpening at angle $2\theta$ in blanks (see FIG. 11). In FIG. 14 an alternative embodiment having two discrete values of thickness of the planes $\delta_3$ and $\delta_4$ is shown. Thus the thickness of the root and tip planes are as they are in FIG. 5: $\delta_1$ and $\delta_2$. The load-carrying chain of the control surface is locked in the root part with the load-carrying bracket 26 (see FIG. 5), made previously as one-piece joint from $\pi$-shaped and angle roof-shaped sections, processed previously at fixing areas and jointed with bent members of side bars 18 and 19 (see FIG. 5).

As was already indicated above, a cellular unit of the lattice control surface consisting of few W-shaped plates, root 22 and tip 23 planes, for convenience of technology may be assembled previously by means of one-piece jointing, for example, by electrostatic or spot welding, processed at fixing areas that are in contact with side bars 18 and 19 (see FIG. 5), at area of W-shaped plates jointing in a zone of base areas (sharpening of edges), together with a load-carrying bracket 26 installed in the side bars 18 and 19 and assembled finally by one-piece jointing, for example, by welding or soldering at contact areas (see FIGS. 6, 7, 8, 9). Then through apertures $\phi_d$, $\phi_D$ and dimension "E" for attachment of the control surface to the control drive shaft are made in the eyes. At the same time in the obtained modular design finishing operations are carried out: removal of flashes at sharpened edges of side bars and planes.

It is necessary to note, that for drag reduction of the design (shifting of a shock wave to a higher range of flight speeds) a taper 27 is made (see FIG. 15) at front sharpened edge of side bars 18 and 19 (see FIG. 5), simultaneously protecting the front sharpened ends of the lattice planes from damage. For the same purpose the rear edge 28 of the side bars 18 and 19 is removed from the back sharpened ends of the lattice planes at distance "k" (see FIG. 15). Width of the lattice planes is "b" (see FIG. 15).

The claimed lattice control surface of a rocket works as follows. In the presence of an air flow across the lattice control surface at some angle of attack $\alpha$ to the surface of the planes, the lifting area of the lattice control surface made of the rectangular planes, will create lift on the control surface. Lift arising on the lattice control surface, being transferred by the load-carrying design of the control surface through units of attachment (eyes with apertures—FIG. 13) on the control drive axis, generally creates hinge moment $M_h$, loading the drive.

The planes of the lattice control surfaces (see FIGS. 5, 11) are profiled by appropriate selection of a pitch "t" (for the control surface), thickness $\delta_i$, sharpening angles $2\theta$ of front and rear edges, in order to obtain smooth (or laminar) flow-around up to angles of attack 40°–50°, which significantly increases dynamic characteristics of the rocket.

At supersonic flight speeds the planes of a lattice may be located rather close to each other without their mutual influence through a shock wave and to obtain large total area of a lattice aerodynamic surface in small volume, i.e. to improve the manoeuvrability of the rocket. For example, at M=4 lift of a lattice surface approximately exceeds by a factor of approximately 3 the lift of an appropriate monoplane wing at equal volumes, which in certain conditions gives to lattice control surfaces a number of advantages in comparison with conventional monoplane control surfaces.

As a lattice control surface, as was already mentioned above, represents a thin-walled truss (i.e. light and strong design), and the ratio of thickness of the planes and frame components can be expressed in some cases by relation 1:20, which results in high level of material operating ratio (M.O.R.), which is within limits from 0.5 up to 0.9. This factor is calculated under the formula:

$$M.O.R.=G/N,$$

Where:

G—mass of product,

N—norm of material consumption.

However it is necessary to note, that drag acting on a design placed in flow at flight can considerably reduce the effect of a lattice control surface implementation.

Proceeding therefrom, in the claimed design of a lattice control surface almost all known ways of drag reduction are utilized.

- Contouring (decreasing of thickness at span) for side bars and sharpening of their front and rear edges;
- Contouring (selection of thickness and sharpening angle) for root and tip planes, and lattice planes;
- Creation of "cellular blocks" assembly technology for a control surface lattice through base areas of pre-formed W-shaped plates;
- Making a root part of a lattice control surface more rigid through placing its attachment units closer to each other and introduction of a special bracket for decrease of possible deformation in flight; and
- Formation of attachment units for a control surface to a control drive shaft, allowing the root part of the lattice control surface to be recessed in the body of the rocket.

The listed measures of a rocket lattice control surface perfection serve to ensure smoother (no-separated) flow-around of a lattice control surface, i.e. lower aerodynamic drag, which allows solution of problem of the necessary rocket and control drive characteristics in a more flexible way, including for example geometrical characteristics of a rocket, its dynamic properties, power, moment of inertia of the drive executive component etc.

The shape of a lattice control surface, used in a system of a rocket aerodynamic control, directly influences such factors as capability of its folding in an "initial" condition along a rocket body, capability of its deployment in flight only under action of constant aerodynamic forces, capability of the hinge drive moment reduction etc.

An advantage of the claimed invention, as design studies of a complex "lattice control surface—control drive—rocket" have shown, is that it enables solution of the above-stated integrated problems solution over a full range of rocket performance, including angles of attack up to 40°–50°.

The claimed rocket (see FIG. 16) contains the body 1, including the forward fairing 29 of ogival shape. Inside the body 1 apparatus of the guidance and control systems are located, and also the propulsion system (not shown on the drawings).

The rocket is designed according to a standard aerodynamic design, in accordance with which four wings 2 on the body 1 in its central part and four lattice control surfaces 3 in the tail part are located. Wings 2 and control surfaces 3 are located on the body 1 in regular intervals around its centerline. There are the eyes 30 in the root part of the control surface 3, by each of them the control surface fastens to the control drive shaft.

For improvement of the aerodynamic characteristics of a rocket the following dimension ratios of rocket body 1, wings 2, and control surfaces 3 are chosen, namely:

$$\bar{S}_w = 2S_w / S_M = 3-11; \quad \bar{S}_p = 2S_p / S_M = 1.5-3; \quad H_p / L_p = 0.3-0.55;$$

$$\bar{t}_p = t/b = 0.6-1; \quad n = H_p / t + 1 = 3-5;$$

$$S_p = nL_p b; \quad \lambda_w = L^2 / 2S_w = 0.2-0.5;$$

$$\lambda_k = L_k / D_{eq} = 16-20; \quad D_{eq} = \sqrt{4S_M / \pi}$$

Where:

$S_w$ - Area of wing;

$\bar{S}_w$ - Specific area of wing;

$\bar{S}_p$ - Specific area of lattice control surface;

$S_M$ - Mid-section area of rocket;

$H_p$ - Height of lattice control surface;

$S_p$ - Area of lifting surface of lattice control surface;

$L_p$ - Span of lattice control surface;

$\lambda_w$ - Wing elongation;

$L$ - Span of wing;

$\lambda_k$ - Rocket body elongation;

$L_k$ - Rocket length;

$t$ - Pitch of planes of lattice control surface;

$D_{eq}$ - Diameter of circle, area of which equals mid-section area of rocket;

$b$ - Width of lattice control surface plane;

$\bar{t}_p$ - Specific pitch of lattice control surface planes;

$n$ - Number of planes of lattice control surface.

An alternative rocket design is the variant in which the rocket has the following parameters within the specified above ratios for these parameters:

$\bar{S}_w$=5.1;
$\bar{S}_p$=2.2;
$H_p/L_p$=0.45;
$\bar{t}_p$=0.9;
n=4;
$\lambda_w$=0.305;
$\lambda_k$=18

These parameters ratios provide one of possible optimum versions of rocket design and allow it to keep drag and normal force coefficients within certain limits, and thereby maintain superior manoeuvrability properties.

Rockets with wings of small length, providing small transverse overall dimensions, are intended for manoeuvring at large angles of attack. From the aerodynamic point of view, such configurations have the following distinctive features:

Presence of cross connections;

Presence of large local angles of attack at control surfaces.

Selection of lattice control surfaces, wings and rocket body dimension ratios within certain limits allows reduction or elimination of a number of technical problems (or some part of these problems).

Manoeuvring at large angles of attack ($\alpha \approx 40°$) allows assurance of a high level of transverse g-loads in all ranges of rocket implementation.

As it is known, the value of transverse g-load is proportional to normal force value of a rocket, which is determined under the formula:

$$Y=C_y qS,$$

where:

$C_y$—factor of rocket normal force;

q—velocity head, [kg/m$^2$];

S—characteristic dimension, [m$^2$].

The value of a rocket flight range is inversely proportional to a rocket drag force, which is calculated under the formula:

$$X=C_x qS,$$

where $C_x$—drag coefficient of rocket.

In FIGS. 19–22 relations for $C_{xo}$, $C_y$, depending on claimed parameters of a rocket and lattice control surface are adduced. A rocket with the claimed ratios of dimensions provides the highest manoeuvrability characteristics at minimum of a drag coefficient.

The presented parameters (shaded areas) are determined as a result of systematic researches in wind tunnels for rockets of various geometrical dimensions and are confirmed by results of flight tests.

At falling outside the limits of the claimed parameters a rocket largely loses the manoeuvrability properties due to a significant decrease in normal force factor and increase in drag coefficient.

Thus, the rocket with the claimed ratios of dimensions provides high aerodynamic characteristics in all ranges of its implementation, maximum permissible g-load is $n_{y\ max}\approx 50$ at angles of attack $\alpha_{max}\approx 40–45°$.

The graphic relations in FIGS. 19–22 confirm capability of the high aerodynamic characteristics obtaining in an interval of dimension ratio values for wings, lattice control surfaces and rocket body that was made as a standard aerodynamic design.

What is claimed is:

1. A rocket comprising lattice control surfaces, the rocket comprising a propulsion system located in a body (1), an apparatus of control and guidance systems, fixed wings (2) and lattice control surfaces (3) of a control system, located on a body (1) in regular intervals around a centerline of the body and having lifting surfaces formed by planes (9), characterized in that the wings (2), lattice control surfaces (3) of the control system and the body (1) are made in such a manner that they have the following dimension ratios:

$$\bar{S}_w = 2S_w / S_M = 3-11;\quad \bar{S}_p = 2S_p / S_M = 1.5-3;\quad H_p / L_p = 0.3-0.55;$$
$$\bar{t}_p = t/b = 0.6-1;\quad n = H_p / t + 1 = 3-5;$$
$$S_p = nL_p b;\quad \lambda_w = L^2 / 2S_w = 0.2-0.5;$$
$$\lambda_k = L_k / D_{eq} = 16-20;\quad D_{eq} = \sqrt{4S_M / \pi}$$

Where:

$S_w$ - Area of wing;

$\bar{S}_w$ - Specific area of wing;

$\bar{S}_p$ - Specific area of lattice control surface;

$S_M$ - Mid-section area of rocket;

$H_p$ - Height of lattice control surface;

$S_p$ - Area of lifting surface of lattice control surface;

-continued $L_p$ - Span of lattice control surface;

$\lambda_w$ - Wing elongation;

$L$ - Span of wing;

$\lambda_k$ - Rocket body elongation;

$L_k$ - Rocket length;

$t$ - Pitch of planes of lattice control surface;

$D_{eq}$ - Diameter of circle, area of which equals mid-section area of rocket;

$b$ - Width of lattice control surface plane;

$\bar{t}_p$ - Specific pitch of lattice control surface planes; and $n$ - Number of planes of lattice control surface.

2. A rocket comprising lattice control surfaces, the rocket comprising a propulsion system located in a body (1), an apparatus of control and guidance systems, fixed wings (2) and lattice control surfaces (3) of a control system, located on a body (1) in regular intervals around a centerline of the body and having lifting surfaces formed by planes (9), characterized in that the wings (2), lattice control surfaces (3) of the control system and the body (1) are made in such a manner that they have the following dimension ratios:

$$\bar{S}_w = 2S_w / S_M = 3-11;\quad \bar{S}_p = 2S_p / S_M = 1.5-3;\quad H_p / L_p = 0.3-0.55;$$
$$\bar{t}_p = t/b = 0.6-1;\quad n = H_p / t + 1 = 3-5;$$
$$S_p = nL_p b;\quad \lambda_w = L^2 / 2S_w = 0.2-0.5;$$
$$\lambda_k = L_k / D_{eq} = 16-20;\quad D_{eq} = \sqrt{4S_M / \pi}$$

Where:

$S_w$ - Area of wing;

$\bar{S}_w$ - Specific area of wing;

$\bar{S}_p$ - Specific area of lattice control surface;

$S_M$ - Mid-section area of rocket;

$H_p$ - Height of lattice control surface;

$S_p$ - Area of lifting surface of lattice control surface;

$L_p$ - Span of lattice control surface;

$\lambda_w$ - Wing elongation;

$L$ - Span of wing;

$\lambda_k$ - Rocket body elongation;

$L_k$ - Rocket length;

$t$ - Pitch of planes of lattice control surface;

$D_{eq}$ - Diameter of circle, area of which equals mid-section area of rocket;

$b$ - Width of lattice control surface plane;

$\bar{t}_p$ - Specific pitch of lattice control surface planes; and $n$ - Number of planes of lattice control surface;

the rocket having deployment mechanisms for deployment of the control surfaces and restraint of the control surfaces in unfolded and folded positions, the lattice control surfaces (3) comprising pins (8) with grooves for fixation of control surfaces (3) in a folded position, the rocket body (1) comprising apertures for control surface pins (8), and a root part of control surfaces (3) comprising assembly apertures, each control surface deployment mechanism comprising a pneumatic cylinder (15) located in a rocket body (1), a chamber under a piston of which is connected with a pyrotechnic pressure accumulator, and the piston being loaded by a spring (16) for its fixation in its end position at deployment of the control surface (3), and a rod (4), fixed in a front part of an end (5) of a shaft of a control surface drive the rod having ends located in correspondent assembly apertures of a root part of a control surface (3); each mechanism of a control surface restraint in an unfolded position comprising rods (6) loaded by a spring (7), located in rear part of an end (5) of a shaft of a control surface drive and adapted to engage a corresponding assembly aperture in the root part of the control surface (3), and each mechanism of the control surface restraint in a folded position comprising clamping scissors (11), loaded by a spring (10), installed at an axle (12) in a rocket body (1) and adapted to engage pins (8) of the control surfaces (3) in their folded position and rods (17) of pistons of pneumatic cylinders (15) in an unfolded position of the control surfaces (3), and rods (17) having lengths sufficient to ensure their ability to block apertures of the rocket body (1) at an unfolded position of control surfaces (3).

3. A rocket in accordance with claim 2, characterized in that a pin (8) of each control surface (3) is mounted on crossed planes (9) of the lattice control surface (3) near a centre of mass of the control surface.

4. A rocket in accordance with claim 3, characterized in that a pin (8) of each control surface (3) is of sufficient length to ensure formation of a gap between the body (1) of the rocket and the appropriate lattice control surface (3).

5. A rocket in accordance with claim 2, characterized in that a rod (17) of a piston of each pneumatic cylinder (15) has a groove for fixation of the rod by clamping scissors (11) at an unfolded position of lattice control surfaces (3).

6. A lattice control surface of a rocket, comprising a load-carrying frame of a rectangular shape, including side bars (18, 19), root (22) and tip (23) planes and units adapted for attachment of the lattice control surface (3) to a drive shaft, and a set of planes (24, 25) of different thickness located inside a frame, forming a lattice as honeycomb, characterized in that side bars (18, 19) of the frame are made with smoothly decreasing thickness, the root (22) and tip (23) planes of the frame made of different thickness; and planes (24, 25) of a lattice are made with smooth or discrete reduction of thickness, narrowing at length of a plane from root to tip portion along the span of a control surface.

7. A lattice control surface of a rocket in accordance with claim 6, characterized in that planes of a lattice are formed by jointing rows of pre-formed W-shaped plates of various thickness from row to row, smoothly or discretely tapering along the span of the control surface to its tip portion, resting by ends at internal surfaces of side bars (18, 19) of the frame, and envisioned direct lines drawn through initial apexes of projections for each row of W-shaped plates are parallel to a root (22) plane of a frame.

8. A lattice control surface of a rocket in accordance with claim 7, characterized in that conjugated apexes of W-shaped plates in areas of contact among themselves have base areas.

9. A lattice control surface of a rocket in accordance with claim 7 characterized in that the W-shaped plates are jointed among themselves and to the frame as a single-piece detail by welding or soldering.

10. A lattice control surface of a rocket in accordance with claim 6 characterized in that the planes (24, 25) of the lattice, and planes (22, 23) and side bars (18, 19) of the frame comprise wedge-shaped sharpening of leading and trailing edges.

11. A lattice control surface of a rocket in accordance with claim 10 characterized in that the edges of planes (24, 25) of the lattice are symmetrically sharpened.

12. A lattice control surface of a rocket in accordance with claim 6 characterized in that units of a control surface attachment to a drive shaft are located in a central part of the root (22) plane of a frame and are formed by bent members (20, 21) of side bars (18, 19) of a frame, jointed among themselves and with the root plane (22) of the frame by a load-carrying bracket (26).

13. A lattice control surface of a rocket in accordance with claim 12 characterized in that the load-carrying bracket (26) is made by jointing of π-shaped and roof-shaped sections, and the legs of the π-shaped section are connected to angled members (20, 21) of the frame side bars (18, 19) forming attachment eyes, and an apex of the roof-shaped section is connected to a root plane of a frame, and through apertures are made for a control surface (3) attachment to a shaft of a control drive.

14. A lattice control surface of a rocket in accordance with claim 8 characterized in that the W-shaped plates are jointed among themselves and to the frame as a single-piece detail by welding or soldering.

15. A lattice control surface of a rocket in accordance with claim 7 characterized in that the planes (24, 25) of the lattice, and planes (22, 23) and side bars (18, 19) of the frame comprise wedge-shaped sharpening of leading and trailing edges.

* * * * *